US006836934B2

(12) United States Patent
San Miguel De Juana et al.

(10) Patent No.: US 6,836,934 B2
(45) Date of Patent: Jan. 4, 2005

(54) SAFETY HINGE

(76) Inventors: Julián San Miguel De Juana, Plz. de la Cruz 4.47162 Aldeamayor de San Martin, Valladolid (ES); Gaspar Soto Fernandez, Paseo Isabel la Católica 22, 11B. 47003, Valladolid (ES)

( * ) Notice: Subject to any disclaimer, the term of this patent is extended or adjusted under 35 U.S.C. 154(b) by 0 days.

(21) Appl. No.: 10/239,340

(22) PCT Filed: Mar. 13, 2001

(86) PCT No.: PCT/SE01/00096

§ 371 (c)(1),
(2), (4) Date: Sep. 18, 2002

(87) PCT Pub. No.: WO01/71137

PCT Pub. Date: Sep. 27, 2001

(65) Prior Publication Data

US 2003/0029000 A1 Feb. 13, 2003

(30) Foreign Application Priority Data

Mar. 22, 2000 (ES) ..... P 200000695

(51) Int. Cl.[7] ..... E05D 7/06; E05D 11/10
(52) U.S. Cl. ..... 16/348; 16/360
(58) Field of Search ..... 16/228, 348, 357, 16/360–361, 389, 355, 362, 364; 49/383, 497

(56) References Cited

U.S. PATENT DOCUMENTS

| | | | | | |
|---|---|---|---|---|---|
| 1,840,211 A | | 1/1932 | Reinhart | | |
| 2,620,509 A | | 12/1952 | Keating | | |
| 2,883,699 A | | 4/1959 | Gross | | |
| 3,598,442 A | * | 8/1971 | Miller | | 16/364 |
| 6,243,919 B1 | * | 6/2001 | Hetland | | 16/360 |
| 6,427,288 B1 | * | 8/2002 | Saito | | 16/361 |

FOREIGN PATENT DOCUMENTS

| | | | | |
|---|---|---|---|---|
| CH | 369042 | | 6/1963 | |
| FR | 8413885 | | 4/1986 | |
| GB | 2001699 A | * | 2/1979 | E05D/03/06 |
| GB | 2252787 | | 8/1992 | |
| WO | WO 98/16708 | | 4/1998 | |

* cited by examiner

*Primary Examiner*—John D. Walsh
*Assistant Examiner*—Christopher Boswell
(74) *Attorney, Agent, or Firm*—Epstein Drangel Bazerman & James, LLP.

(57) ABSTRACT

As from a conventional semi-hinge fixed to the frame, a complementary door fixing semi-hinge having, emerging perpendicularly from its base plate (1), a slide (3) destined to be housed in a blind hole on the door edge, a slide which is closed by its free end by means of a lid (12) and having a pair of opposite longitudinal guides (4), in which respective sets of balls have been fitted for the sliding of a runner (8), provided with complementary guides (4') for the mentioned set of balls and which is an elbowed extension of an arm (9) finishing in the bushing (10) or hinge itself, across which this semi-hinge is articulated to the semi-hinge fixed to the frame. Complementarily, slide (3) and runner (8) define a cylindrical housing (5–5') in which a spring (7) is housed, which in the case of the upper hinge tends to press the leaf against the frame and in the case of the lower hinge, tends to separate these components.

5 Claims, 3 Drawing Sheets

SAFETY HINGE

OBJECT OF THE INVENTION

The present invention refers to a hinge, intended to constitute the means of hinging doors, windows, traps, and similar devices, whose structural characteristics have been conceived to provide a safety element which, without any special modification, either in the leaf or the frame, prevents the injuries accidentally produced when a person, generally a child, is closing the leaf and has his/her fingers or another part of the body between the leaf and frame in the hinging area.

BACKGROUND OF THE INVENTION

In any door, window or similar hinged device, between the frame and leaf there is, in the open position of the latter, a considerably wide angle, permitting for example the introduction of fingers such that if the leaf is accidentally closed a severe injury is produced. Therefore, it is necessary to take into account that the force exerted, for example, over a door handle, is multiplied approximately twenty times at the pivot level, due to the lever arm of the door itself, such that injuries may be considerably.

In an attempt to eliminate this problem, door designs are known which are hinged on thei6r upper and lower faces having an edge and housing in a rounded frame, such that the angle is not formed, solving the aforementioned problem, on not permitting the introduction of fingers or any other part of the body/in said space. However, this solution is expensive since it means the replacement of standard doors by special ones.

The availability of an accordion shaped part is also known, as an extension of the classic stepping of the frame, tending to conceal the aforementioned angle, but this solution, besides negatively influencing the aesthetics of the combination, only partially solves the problem since the risk of accidents continues, now between the hinged leaf and the flat iron itself, although in this case, injuries will be slightly less severe, especially when using an easily yieldable flat iron.

A third solution consists of using hinges that displaces the door leaf with respect to the frame, when there is an object in the closing area.

Along this way it is interesting to mention the French patent FR-2571417 in which the upper semi-hinge, instead of being directly fixed to the conventional base plate, which in turn is used to fix the semi-hinge to the corresponding edge of the door, is fixed by means of a mobile arm in which there is a recessed housing containing a rod interlocked to said base plate, so that under normal conditions, the arm of the semi-hinge itself is maintained embedded in the base plate, being jointly mobilised with the latter and the leaf itself, whilst in the event of an obstacle in the closing area, a swinging of the arm is produced with respect to the base plate provoking a distancing of the leaf with respect to the frame, hence preventing damage or injury to objects between these components, such as fingers.

However, this solution only exerts the effect sought in the upper level of the door, whilst at the lower level, the tendency of the total adaptation between the door and the frame is maintained at all times, making the solution effective in the upper area of the door and practically ineffective in the lower part, which is precisely the area with the greatest risks of accidents, especially with respect to children.

Likewise, this solution has another evident and severe drawback from the standpoint of the user's safety, being the great pressure to which the skin of the trapped limb is submitted on displacement of the edge when said trapping occurs.

Finally, from the design standpoint, this solution has the drawback of difficult calibration due to the fact that the elastic component is also supporting.

DESCRIPTION OF THE INVENTION

The safety hinge proposed by the invention, belonging to the third type of option indicated in the previous section, namely, the group which base their safety on the displacement of the leaf with respect to the frame whenever necessary, completely solves the aforementioned drawbacks, assuring wide functionality both at the upper and lower levels, as well as a perfect uniformity throughout and all the latter parallel to an optimum functionality of the door, window or similar device being considered.

For this reason and more specifically, as an extension of the conventional fixing plate screwed to the edge of the door, the upper semi-hinge of each hinge is provided with a slide perpendicular to said plate and destined to be housed in a blind recess on the edge of the leaf. Said slide has two longitudinal, parallel, superimposed tracks for displacement by rolling, with the interposition of two sets of balls, a runner, in turn provided with another two tracks opposite to those of the slide and by means of which the latter is related by means of the mentioned sets of balls, a runner which is finished at one of its ends in the hinge itself with an articulated joint to the other semi-hinge.

As a complement of the described structure, the runner incorporates a grooved and lateral recess in which there is an intermediate and fixed bracket, so that said grooved recess, together with another one defined in the slide, determines a cylindrical housing between both components in the assembly situation thereof, there being in said cylindrical housing, a spring which in the case of the lower hinge of the leaf tends to separate the leaf from the frame, whilst in the case of the upper hinge it tends to bring it closer, so that an effect is obtained compensating the tendency of the door to swing over its same plane, due to the offcentring of its centre of gravity with respect to the hinge axis or, in other words, it is achieved that the pressure with which leaf displacement is produced with respect to the frame is practically the same along an imaginary hinging line, that is, in all the height of the door.

Said tracks for the sets of balls between the slide and runner are closed at their ends, the structure described being completed with a lid that closes the inside end of the slide in the bottom of the blind hole of the door and which is provided with two spigots which duly placed opposite the rolling tracks, limit displacement of the balls.

In this way, the runner run remains limited through its inside end by said lid and through its zone next to the base plate by the spring or guide spigot.

According to the structure described and specifically compared with the aforementioned French patent, the hinge of the invention offers a series of advantages that are mainly centred on the following aspects:

- There is no rubbing or wear due to using the sets of balls with the added advantage that the use of greases is unnecessary which may deteriorate with the passing of time and jam the mechanism.
- It permits an accurate adjustment of the threshold from which the mechanism starts to operate by means of the appropriate tension springs.

The mechanism always displaces the leaf following an axis parallel to the trapping force which favours the prevention of injuries.

The mechanism perfectly functions independently from the opening of the door leaf.

The door machining is very simple and does not affect its structure, such that the door appearance is completely normal.

All the integrating components thereof are designed to be easily injected in plastic or metal, although the configuration is also easily adaptable to manufacture by plate stamping.

Finally and essentially, the force exerted on the trapping is practically independent of the height level at which the latter occurs.

DESCRIPTION OF THE DRAWINGS

To complete the description being made and with the purpose of better understanding the features of the invention in accordance with an embodiment thereof, a set of drawings is attached which show the following with an illustrative and non-limiting character.

PREFERRED EMBODIMENT OF THE INVENTION

Figure 1:
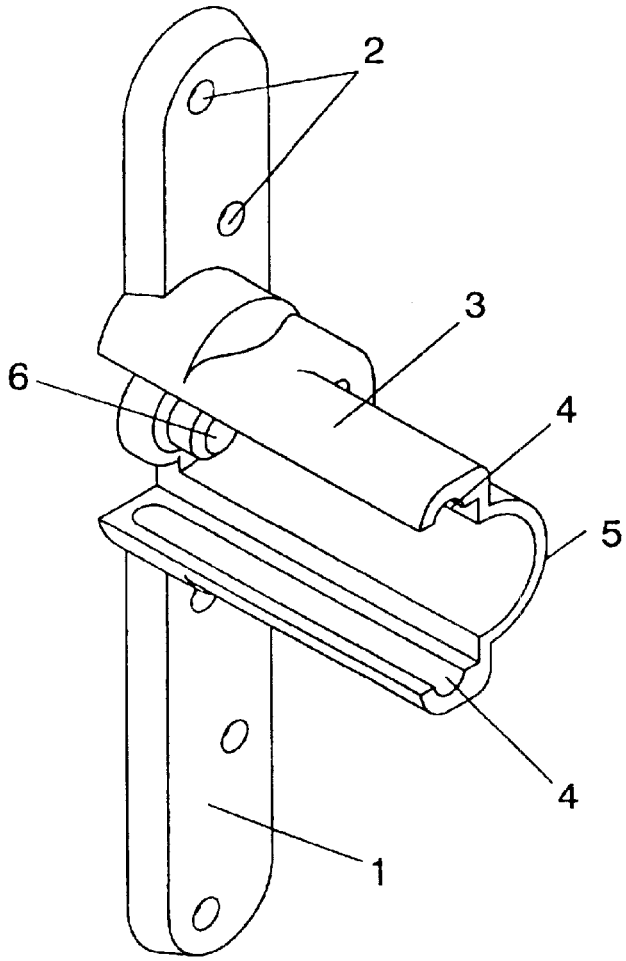
FIG. 1 shows a perspective view of one of the two essential components participating in the hinge proposed by the invention, specifically the slide intended to be fixed to the leaf.
Figure 2:
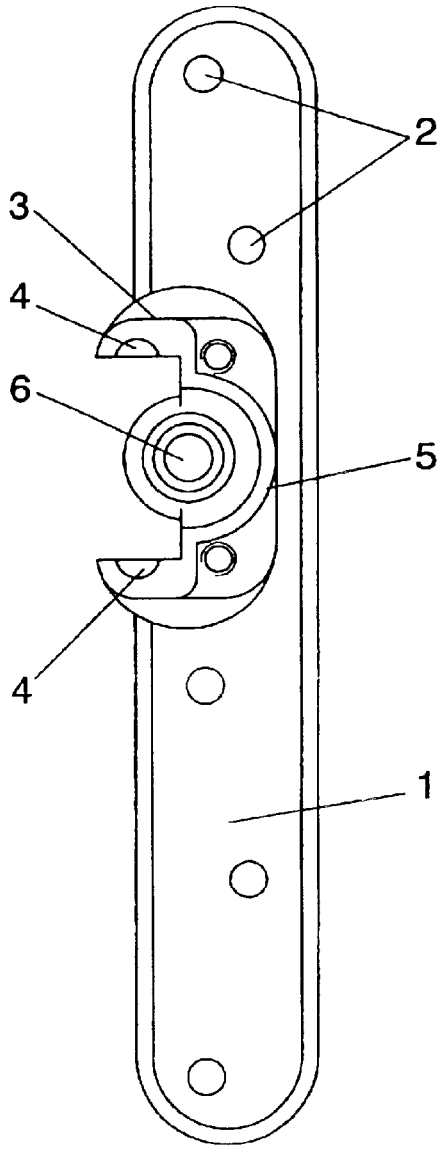
FIG. 2 shows an elevation view of the part of the previous figure, along its face adapted to the edge of the leaf.
Figure 3:
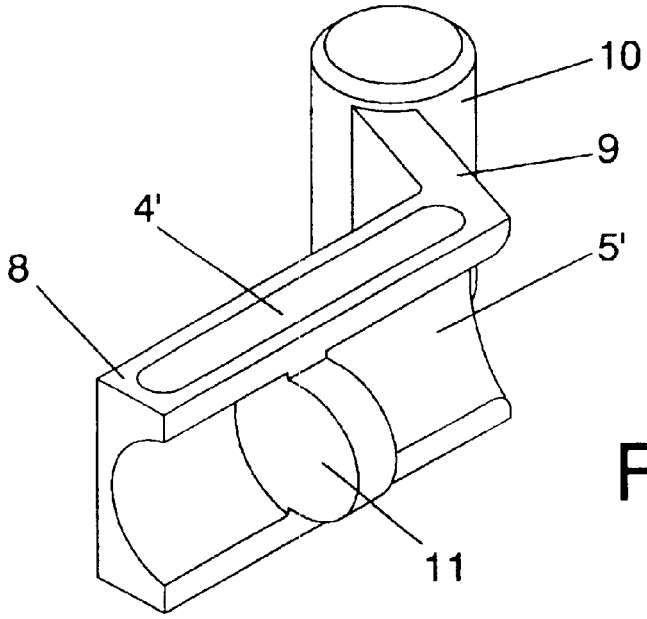
FIG. 3 shows a perspective view of the complementary runner of the slide of the previous figures.
Figure 4:
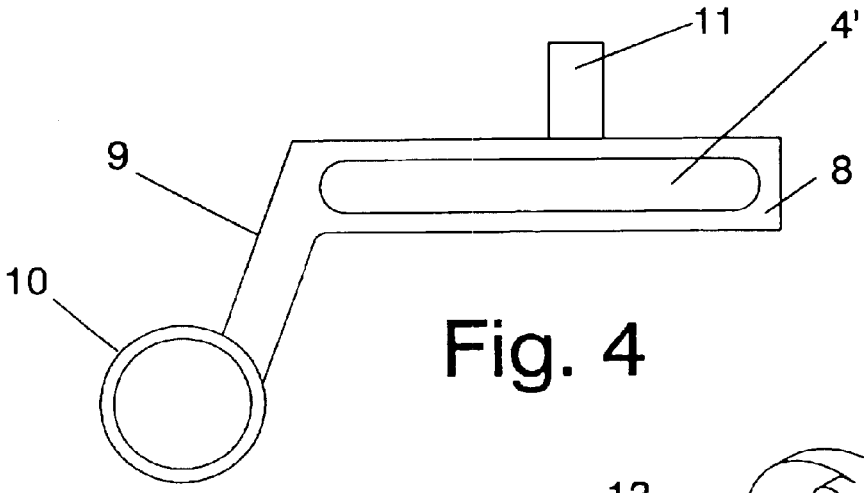
FIG. 4 shows a plan view of the same runner.
Figure 5:
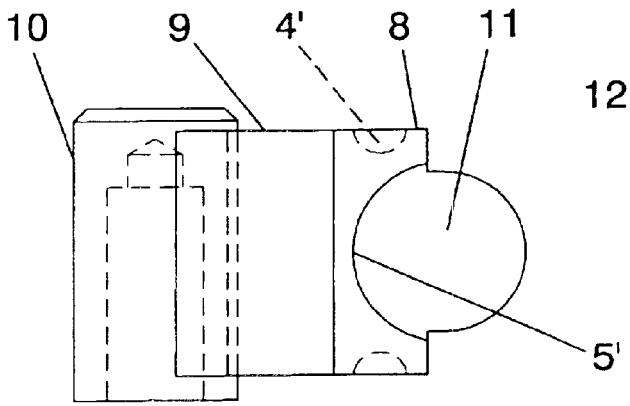
FIG. 5 shows a side elevation view of the runner.

In the light of the figures shown, it may be seen how in the proposed hinge, the conventional extended base plate (1), fixed to the door leaf, window or item in question, with the conventional screw holes (2) to said edge, in a greater amount than in the conventional hinge and unaligned to improve the fastening conditions, holes (2) which leave a central area of the hinge free, where the grooved slide (3) is situated and in whose interior two guides (upper and lower) (4) are created, which frame a lateral semi-cylindrical recess (55), said plate (1) having, in coaxial arrangement with respect to the slide (3), a spigot (6) acting as a centring device for a spring (7) acting over a runner (8) intended to longitudinally slide inside the slide (3), provided for such a purpose with guides (4') duly opposite the slide (3) guides (4), so that among them, respective sets of balls are established, not represented in the drawings for greater clarity thereof, said runner (8) emerging from an arm (9) forming an obtuse angle with the same and which terminates in the hinge itself (10), that is, in the vertical bushing where the hinge operates, said runner (8) incorporates another semi-cylindrical groove (5'), complementary to groove (5) of the slide (3), to configure a cylindrical housing for the mentioned spring (7), with the additional particularity that within this groove (5), there is a self or transverse wall (11), discoidal, acting as a seating limit for the spring (7), which in the case of the upper hinge will be located between said bracket (11) and the base plate (1) as shown in FIG. (9), whilst in the case of the lower hinge as shown in FIG. (10), it will be located between the bracket (11) and the free end of the guide (3), which is closed by means of a lid (12) conveniently interlocked to the same, in this case the spring (7') being different from the spring (7) of the upper hinge since the tension exerted by one or the other should be different, so that in this way the work is also different, with the purpose of compensating the tendency of lateral swinging by the door due to off-centring of its centre of gravity with respect to the hinge axis.

Figure 6:
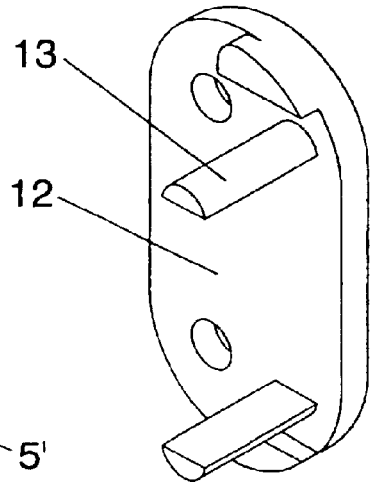
FIG. 6 shows a lower side perspective of the lid complementing the components of the figures above.
Figure 7:
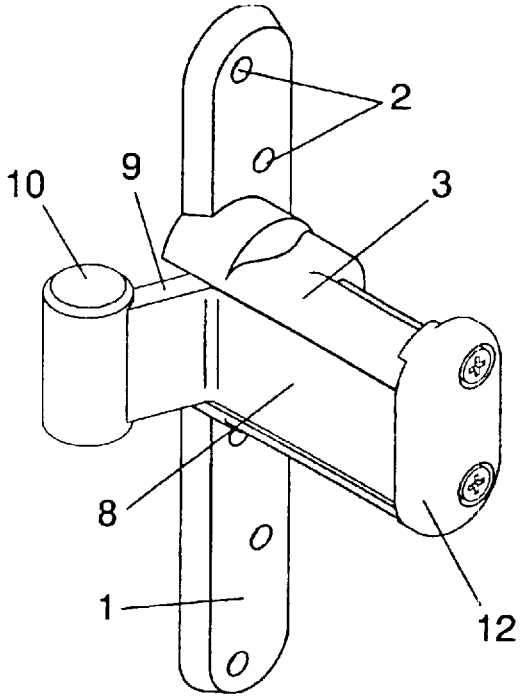
FIG. 7 shows a perspective view of the set of FIGS. 1 to 6 once assembled.
Figure 8:
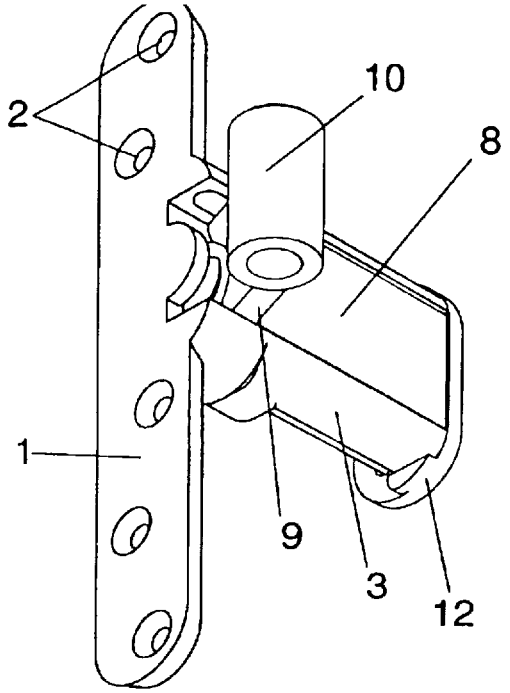
FIG. 8 shows another perspective of the FIG. 7 set, from an observation point opposite to said figure.
Figure 9:
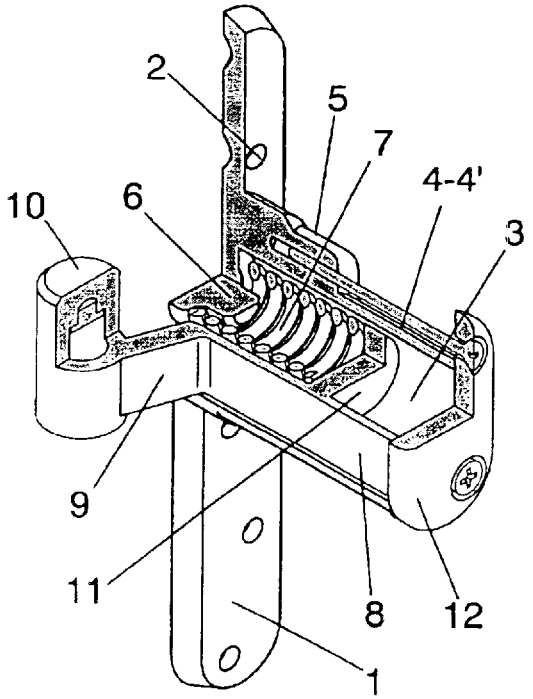
FIG. 9 shows a perspective similar to that of FIG. 7, of the same set of said figure but partially sectioned to more clearly show its internal structure in the specific case of a hinge intended to be located at the upper hinge level of the leaf.
Figure 10:
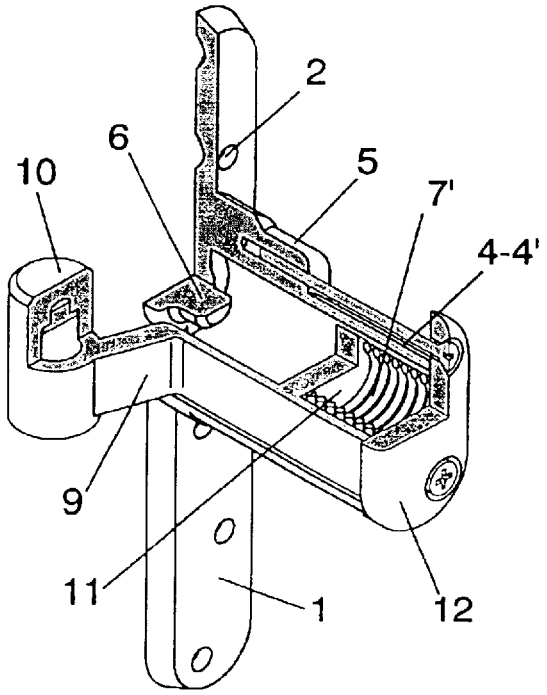
FIG. 10 shows a similar reproduction to that of FIG. 9 but corresponding to a hinge located on the lower hinge of the leaf.

Finally, as observed in FIG. 6, it should be mentioned that the lid (12) is provided with a pair of spigots (13) on its inner face, aligned with the guides (4) and intended to limit the displacement of the balls, so that they never reach the rear or internal end of the guides (4–4') and more specifically, so that the slide tail always remains more behind than the last ball, since when it starts to roll due to trapping its displacement is twofold that of the balls.

In this way, by means of the opposed arrangement of the springs (7–7'), also with an opposite operation, and by means of a suitable level of tension in each one of them, it is possible to balance the different efforts at the upper and lower ends of the leaf due to its weight, so that the safety effect is uniform along the entire line of swinging or hinging.

What is claimed is:

1. A safety hinge of the type used in doors, windows and similar items whose object is to permit a temporary distancing of the leaf with respect to the frame during closing of the former and due to the possible existence of an obstacle between both components, characterized in that one of the semi-hinges participating in the same, that corresponding to the leaf, as an extension of the conventional plate (1) for fixing to the leaf edge, incorporates a slide (3) perpendicular to the same, intended to be housed in a blind hole of the leaf, which slide adopts a grooved configuration and internally incorporates two guides (4–4') for respective sets of balls, across which a runner (8) is related to said guide, said runner longitudinally slides within the same, elbowed extension of an arm (9) finished in the hinge (10) itself or bushing in which the hinge axis moves, associated to the other semi-hinge, that fixed to the frame, having foreseen that these slide and runner elements are also related through an elastic component (7) which tends to maintain the runner (8) totally housed within the slide (3) and hence the leaf in the situation of maximum closeness to the frame, and wherein said elastic component (7) has a spigot (6) acting as a centering means.

2. A safety hinge according to claim 1, characterized in that in the slide (3) there is an internal semi-cylindrical grooving (5) which together with another grooving (5'), laterally defined in the runner (8), creates a cylindrical housing for the mentioned elastic component (7), materialised in a suitable tension spring, the base plate (1), from which the slide (3) emerges in axial arrangement with respect to the latter, while in turn the runner (8) incorporates a transverse bracket (11) over which the other end of the spring leans.

3. A safety hinge of the type used in doors, windows and similar items whose object is to permit a temporary distancing of the leaf with respect to the frame during closing of the former and due to the possible existence of an obstacle between both components, characterized in that one of the semi-hinges participating in the same, that corresponding to the leaf, as an extension of the conventional plate (1) for fixing to the leaf edge, incorporates a slide (3) perpendicular to the same, intended to be housed in a blind hole of the leaf, which slide adopts a grooved configuration and internally incorporates two guides (4–4') for respective sets of balls, across which a runner (8) is related to said guide, said runner longitudinally slides within the same, elbowed extension of an arm (9) finished in the hinge (10) itself or bushing in which the hinge axis moves, associated to the other semi-hinge, that fixed to the frame, having foreseen that these slide and runner elements are also related through an elastic component (7) which tends to maintain the runner (8) totally housed within the slide (3) and hence the leaf in the situation of maximum closeness to the frame, and wherein said slide (3) comprises an internal semi-cylindrical grooving (5) which together with another grooving (5'), laterally defined in the runner (8), creates a cylindrical housing for said elastic component (7), and wherein said base plate (1), from which the slide (3) emerges in axial arrangement with respect to the latter, has a spigot (6) acting as a centering means for said spring (7) and wherein said runner (8) comprises a transverse bracket (11) over which the other end of said spring leans.

4. A safety hinge according to claim 3, characterized in that the slide (3) is closed at its free or inside end with the collaboration of a lid (12) provided with a pair of spigots (13) opposite the guides (4) of the slide (3), not affecting the runner (8) guides (4'), so that said spigots limit the displacement of the balls over said guides (4) of the slide (3).

5. A safety hinge according to claim 4, characterized in that while in the upper hinge, the spring (7) is established between the base plate (1) of the slide (3) and the runner (8) bracket (11), in the lower hinge, the spring (7') is established with a different level of tension between the bracket (11) of the runner (8) and the lid (12) which closes the slide (3), acting in an opposite direction to the spring (7), so that while the hinge of the upper hinge tends to keep the leaf adapted to the frame, the lower hinge tends to separate said leaf from the frame to compensate the swinging tendency of the door due to the shifting of its center of gravity with respect to the imaginary hinge line.

* * * * *